US007233303B2

(12) United States Patent
Tokimoto et al.

(10) Patent No.: US 7,233,303 B2
(45) Date of Patent: Jun. 19, 2007

(54) METHOD OF DISPLAYING HIGH-DENSITY DOT-MATRIX BIT-MAPPED IMAGE ON LOW-DENSITY DOT-MATRIX DISPLAY AND SYSTEM THEREFOR

(75) Inventors: Toyotaro Tokimoto, Yokohama (JP); Masatoshi Oishi, Yokohama (JP)

(73) Assignee: Avix, Inc., Tokyo (JP)

( * ) Notice: Subject to any disclaimer, the term of this patent is extended or adjusted under 35 U.S.C. 154(b) by 220 days.

(21) Appl. No.: 10/690,836

(22) Filed: Oct. 20, 2003

(65) Prior Publication Data

US 2004/0183754 A1 Sep. 23, 2004

(51) Int. Cl.
*G09G 3/32* (2006.01)

(52) U.S. Cl. ..... 345/82; 345/45; 345/55

(58) Field of Classification Search ..... 345/43–46, 345/82–83, 600, 698, 55
See application file for complete search history.

(56) References Cited

U.S. PATENT DOCUMENTS

| | | | | |
|---|---|---|---|---|
| 4,742,558 | A | 5/1988 | Ishibashi et al. | 382/240 |
| 4,779,135 | A | 10/1988 | Judd | 348/565 |
| 5,142,616 | A | 8/1992 | Kellas et al. | 345/634 |
| 5,248,964 | A | 9/1993 | Edgard et al. | 345/634 |
| 5,249,067 | A | 9/1993 | Hirosawa | 358/3.21 |
| 5,258,964 | A | 11/1993 | Koma et al. | 368/47 |
| 5,272,469 | A | 12/1993 | Memarzadeh | 345/173 |
| 5,341,153 | A | 8/1994 | Benzschawel et al. | 345/694 |
| 5,459,484 | A | 10/1995 | Nguyen | 345/644 |
| 5,589,850 | A | 12/1996 | Lin et al. | 345/569 |
| 5,673,120 | A | 9/1997 | Fujii | 358/3.14 |
| 5,767,818 | A | 6/1998 | Nishida | 345/1.1 |
| 5,905,481 | A | 5/1999 | Takaya | 345/55 |
| 5,920,299 | A | 7/1999 | Ohshima et al. | 345/88 |
| 5,926,166 | A | 7/1999 | Khederzadeh et al. | 345/581 |
| 5,929,842 | A | 7/1999 | Vertregt et al. | 345/690 |
| 6,069,610 | A | 5/2000 | Denda et al. | 345/694 |
| 6,690,341 | B2 * | 2/2004 | Tokimoto et al. | 345/55 |

FOREIGN PATENT DOCUMENTS

| | | |
|---|---|---|
| JP | 07-044131 | 2/1995 |
| JP | 08-050459 | 2/1996 |

OTHER PUBLICATIONS

European Patent Office Communication pursuant to Article 96(2) EPC dated May 21, 2004.

(Continued)

*Primary Examiner*—Richard Hjerpe
*Assistant Examiner*—Kimnhung Nguyen
(74) *Attorney, Agent, or Firm*—Jones Day

(57) ABSTRACT

A method of and system for displaying high-density bit-mapped dot-matrix imaging data on a large-scale low-density dot-matrix display is disclosed. Bit-mapped image data from each of multiple and adjacently oriented dot image data groups is allocated to drive one dot of the aforesaid display. This is done through a process in which a data selection sequence standard is employed to alternately select and extract image data from each of the aforesaid dot image data groups continually and repetitively at high speed, and in which the extracted image data from each dot image group is applied to drive one dot on the display.

14 Claims, 6 Drawing Sheets

OTHER PUBLICATIONS

Hartmann, Wilbert J.A.M., Ferroelectric Liquid Crystal Displays For Television Application, 1991, vol. 122, pp. 1-26.

Korean Patent Office Communication dated Apr. 7, 2005.

The Patent Office of the People's Republic of China, Notification of Second Office Action, App. 98105822.1 dated Jul. 4, 2003.

Notification of Reasons for Rejection for Japanese App. No. Hei09-068457, dated Nov. 15, 2005 (with English Translation).

* cited by examiner

METHOD OF DISPLAYING HIGH-DENSITY DOT-MATRIX BIT-MAPPED IMAGE ON LOW-DENSITY DOT-MATRIX DISPLAY AND SYSTEM THEREFOR

BACKGROUND OF THE INVENTION

1. Field of the Invention

The present invention relates to a method of using a large screen low-density dot-matrix display device to display high-density bit-mapped dot-matrix image data. Specifically, the present invention relates to a method of obtaining as fine an image as possible through the aforesaid large screen dot-matrix display.

2. Description of the Related Art

Large-scale dot-matrix displays of the type consisting of an array of vertically and horizontally oriented rows of light emitting diodes are frequently used on buildings, in sports stadiums, and at other locations as a means of imparting information visually. These types of displays use large display surfaces which generally offer a similar image resolution to that of conventional television.

A typical television receiver offers a level of image resolution equivalent to 480 vertical and 720 horizontal display lines. Bit mapped image data applied to this resolution standard is processed as 480 vertical dots by 720 horizontal dots. If this data display standard were to be applied to a large screen dot-matrix display having, for example, a 96 vertical by 144 horizontal dot pattern, the result would be a display that offers only one fifth of the resolution that the bit-mapped image data is capable of.

The simplest way to execute control of this type of display is to thin out the horizontal and vertical dot density to one fifth normal density whereby the 480 by 720 bit-mapped image data is re-formatted into the 96 by 144 pattern, and to drive each dot in the 96 by 144 dot pattern with one bit of data. Through this method, only one dot of image data is used to drive one dot of display within an area in which 25 dots (5×5) of image data are available.

A significant amount of data is lost and image resolution lowered as a result of this image thinning display control method. Furthermore, when only this thinning process is applied, an aliasing effect is generated which significantly lowers image quality. It is known in the art that image format conversion, a process in which image data within a very small image area is averaged, can be applied to reduce the adverse affects of aliasing. Aliasing can be reduced, for example, through the averaging conversion offered by a low-pass filter in which one dot of image data is averaged from twenty five (25) dots (5×5), or from nine (9) dots (3×3) within the 5×5 dot area (in this case, sixteen (16) dots of data (25-9) are ignored). After this format conversion is executed, that one dot of averaged image data is used to drive one display dot on screen. It is also known in the art that a weighted averaging format conversion operation can be applied in which the central portion of a small group of dots is specifically stressed, or "weighted" in the data conversion process. Bilinear, cubic spline, and Gaussian filters are some examples of weighted averaging format conversion.

Low-density bit-mapped image data can be derived from high-density image data through an averaging format conversion process and displayed on a large-scale low-density dot-matrix display device. Once the required control parameters are set, this method results in improved image quality when compared to simple image thinning.

With respect to a structure of display devices, it is advantageous to employ a low-density dot-matrix device for the above high-density image display since recent examples of large-scale display systems generally include a relatively thick and solid panel structure, in which a number of light emitting elements such as a high-intensity LED combination lump. Because of electronic devices for driving the elements installed in the panel structure, the panel structure cannot be transparent. However, in today's planning and designing of buildings with various types of facades such as a curtain wall, there arise needs for a large-scale display device capable of maintaining visibility through the display device as well as the facade. Obviously, the above conventional display device with a solid panel structure cannot be employed for this use.

SUMMARY OF THE INVENTION

It is an object of the present invention to provide a method of using high-density bit-mapped image data to drive a low-density dot-matrix type display device by means of a new display control standard wherein higher visible image resolution is achieved compared to conventional methods.

It is another object of the present invention to provide a display device having a transparent structure capable of maintaining visibility across its structure.

According to one aspect of the present invention, a method of using high-density bit-mapped image data to drive a low-density dot-matrix display device, comprises the steps of allocating each of multiple dot groups oriented in mutual proximity in bit-mapped image data for one display dot on the display device, applying a predetermined image data selection sequence standard to alternately select one image dot of data from within each of the multiple dot groups by means of a repetitive high-speed data selection operation, and supplying each dot portion of the alternately selected data to the display device as one dot of display drive data. The predetermined image data selection sequence standard may include a predetermined image data calculation standard.

According to another aspect of the present invention, a system for displaying high-density dot-matrix bit-mapped image data on a low-density dot-matrix display, employs a method comprising the aforesaid steps.

According to yet another aspect of the present invention, a dot-matrix display device comprises a plurality of cross members intersecting with each other at such intervals as substantially larger than a width of each of the cross members, a plurality of light emitting elements disposed at the intersecting points of the cross members respectively, each of the light emitting elements being shaped so as not to deteriorate transparency of a structure configured by the intersecting cross members, each of the light emitting element being so disposed that an optical axis thereof is oriented substantially perpendicular to a surface of the structure formed by the intersecting cross members, and means for controlling drive of the light emitting elements respectively, the controlling means being distributed in the cross members. The display device may further comprise a plurality of display modules, each of which having substantially the same configuration as the aforesaid display device.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF PREFERRED EMBODIMENTS

The discussion concerning the embodiments of the present invention will be prefaced by a discussion of the large-scale low-density dot-matrix display devices to which the present invention can be applied as a control means.

Transparent Display Panel

Figure 1:
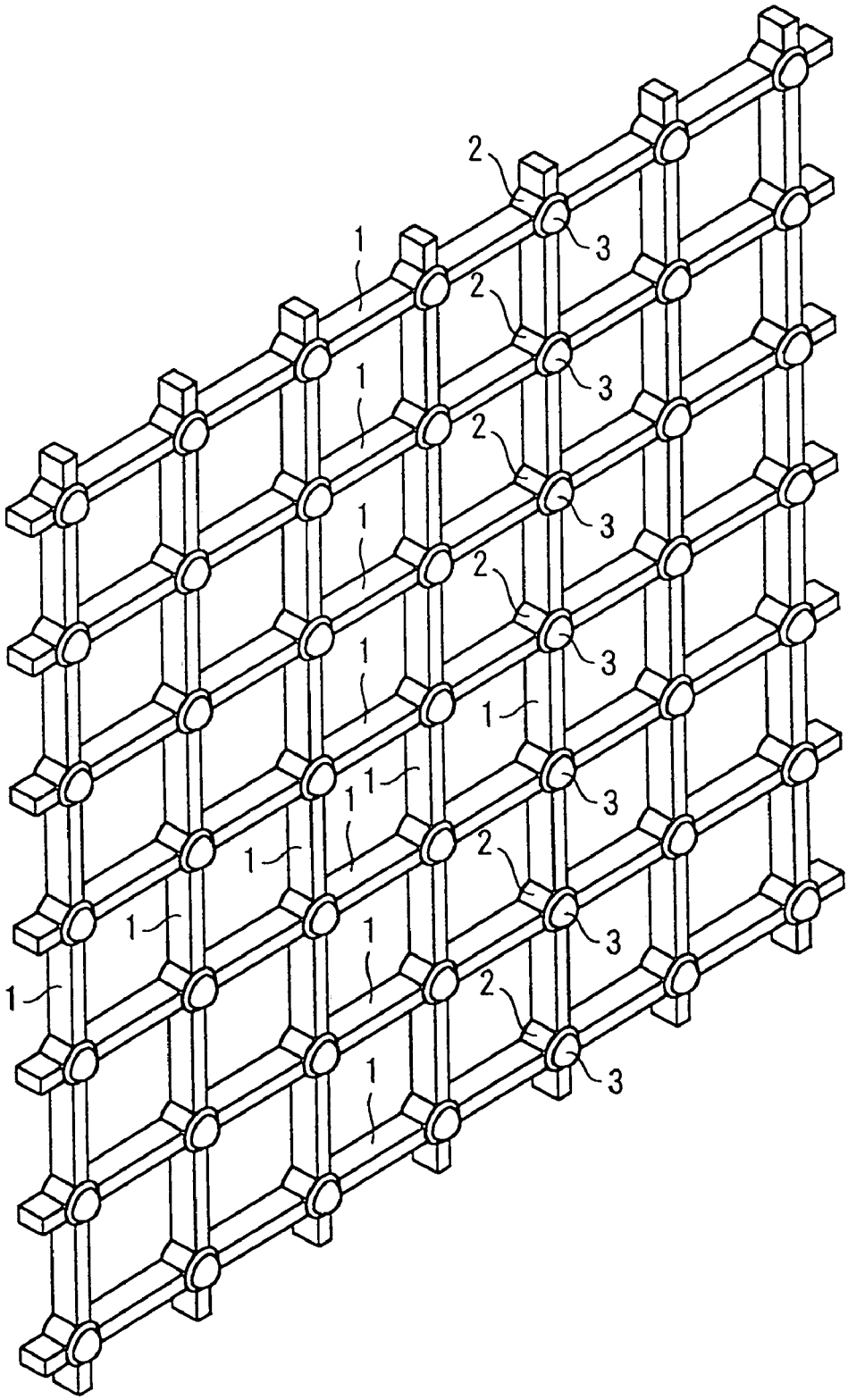
FIG. 1 is an external view of a transparent display panel which can be driven by means of the present invention.

FIG. 1 shows an external view of a transparent type of display panel as one embodiment of the present invention. This display panel comprises vertical and horizontal cross members 1 intersecting at 100 mm intervals to form a non-opaque lattice structure. Each of the cross members 1 is 12 mm in width. Each intersection within the lattice incorporates a 27 mm diameter cylindrical housing 2 which is formed as an integral part of the lattice structure, and high-intensity LED lamps 3 which are installed into each housing 2 and which can incorporate red, green, and blue lamp elements to allow multi-color display. As FIG. 1 shows, the axis of illumination of lamps 3 are perpendicular to the front surface of the display panel.

While FIG. 1 shows seven vertical and seven horizontal cross members 1, these cross members form only a single section of a large-scale display panel which incorporates 128 vertical and 256 horizontal cross members in total, and whose actual dimensions are thirteen (13) by twenty six (26) meters. The entire display panel incorporates 32,768 lamps (128×256) whose illumination can be individually and randomly controlled to provide static or dynamic displays of letters, numbers, and images in a manner similar to a dot-matrix display device. In this embodiment, the display utilizes four (4) bits of data to drive each red, green, and blue lamp respectively, thus requiring a 12-bit data signal. This type of display drive allows the display of up to 4,096 colors.

As will be discussed in more detail eventually, the display drive circuit utilized to control display operation and for driving the respective lamps 3, is divided into several blocks and installed in the lattice structure. Electric wiring runs along the cross members 1 to connect each lamp to its control circuit. A power source is connected to the panel as well as a main control device, such as a desktop computer, which is used to supply display control data to the panel.

This large-scale 13×26-meter display panel is installed in a building on a transparent wall with the lamps 3 facing outward so as to be easily viewed by passersby. As large intervals are formed between the cylindrical housings 2 and the cross members 1 within the lattice pattern, the display allows visibility through the transparent wall to which it is installed, and thus allows people within the building to view the area outside of the building despite the presence of this large-scale display panel. When looking into the building from the outside, the transparent lattice structure of the 13 by 26-meter 128 by 256 dot-matrix display panel makes the panel difficult to see, and allows the lights inside of the building to be clearly visible from outside.

Display Panel Modules

Figure 2:
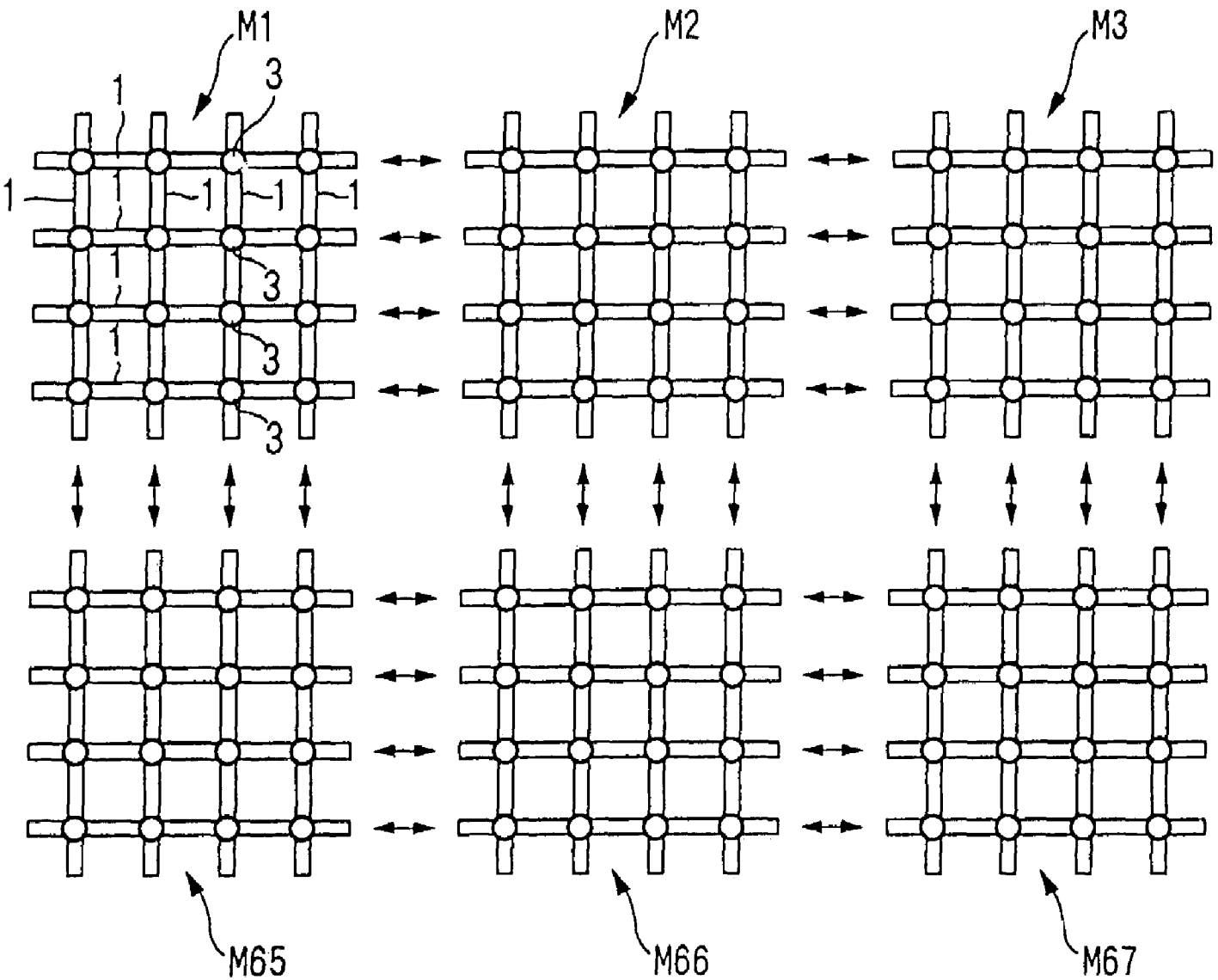
FIG. 2 is a schematic representation of multiple lattice modules which join together to form the transparent display panel shown in FIG. 1.

The aforesaid large-scale dot-matrix display panel is comprised of a multitude of smaller lattice modules as shown in FIG. 2. These modules are designated as M1, M2, M3, etc. in the diagram, and are each comprised of eight cross members 1 wherein four are disposed horizontally and four vertically so as to form sixteen (16) intersection points at which cylindrical housings 2 and LED lamps 3 installed therein. The external dimensions of each module are 40 cm by 40 cm.

The right extremities of horizontal cross members 1 are mated with the left extremities of the horizontal cross members of the lattice module to the right. In the same manner, the top extremities of cross members 1 are mated with the bottom extremities of the cross members of the lattice module above. This interlocking module construction allows multiple lattice modules to be mutually connected and attached to form a large-scale lattice display panel with uniform 100 mm intervals between lattice intersections.

Each lattice module is equipped with a control circuit to drive the sixteen (16) lamps 3 contained therein, a signal transmission circuit for transmission of display drive data between the modules, and a power supply system to supply electrical power to the circuit contained within the module. While space is available for installation of the aforesaid circuits and power supply system within the cross members 1 and the cylindrical housings 2, one of the nine (9) open areas enclosed by the cross members can also be utilized to hold said circuits and power supply by means of a circuit unit or similar device. While the use of an open area within the lattice for the installation of circuit devices will lower the level of transparency of the panel, the uniform dispersion of said circuit devices throughout the display panel will result in minimal loss of panel transparency.

Sixty four (64) of the aforesaid lattice modules are connected horizontally, and thirty two (32) modules are connected vertically to form a 13 by 26-meter large-scale transparent display panel of offering a dot-matrix display pattern comprised of 128 dots by 256 dots. The circuits contained within the sixty four (64) lattice modules on the horizontal axis are connected in series by means of input connectors installed within the left extremities of the cross members 1, and output connectors installed within the right extremities, said connectors being mutually joined when the right ends of the cross members 1 are inserted into the left ends of the cross members of the lattice module to the right as discussed previously.

Wiring Arrangement for the Entire Display Panel

As discussed previously, a 13 by 26-meter transparent display panel having a 128 by 256 display dot pattern is formed by connecting sixty four (64) lattice modules on the horizontal axis and thirty two (32) lattice modules on the vertical axis, each of the aforesaid lattice modules having a 4 by 4 dot display pattern. The aforesaid sixty four (64) horizontally connected lattice modules are electrically connected in series as is shown in FIG. 3.

Figure 3:
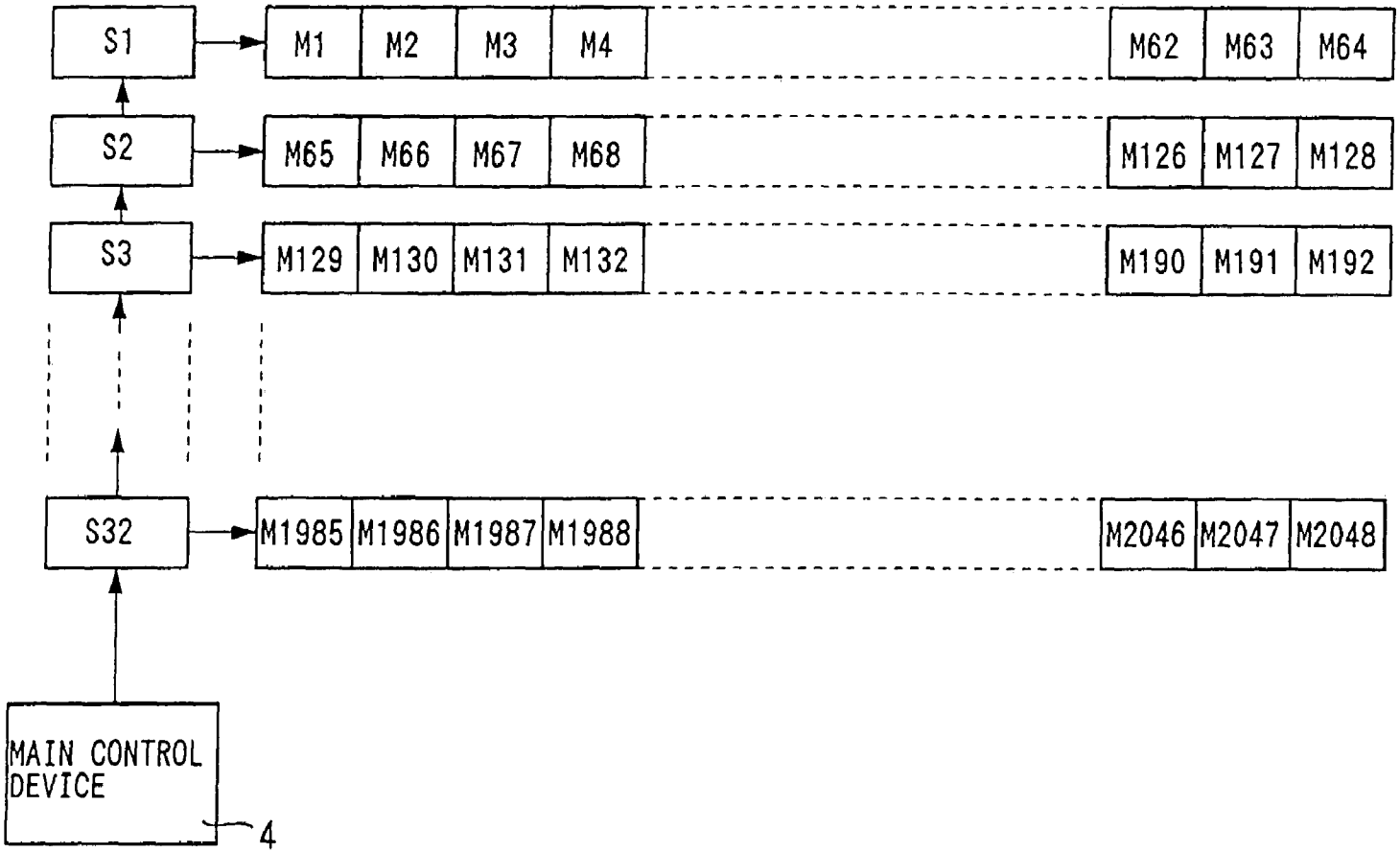
FIG. 3 is a block diagram of the main electrical circuits utilized to drive the display panel shown in FIGS. 1 and 2.

In FIG. 3, a main control device 4 can be a desktop computer or a computer workstation serving as a display control means for the display panel. The main control device 4 contains specific static or dynamic display data files stored on a hard disk or other data storage device, and is able to utilize a computer program to control the distribution of display data through the wiring system of the display panel.

The horizontal array of sixty four (64) connected lattice modules, which are electrically connected in series, is hereinafter referred to as a module line. The embodiment of the display panel structure shown here is comprised of a total of thirty two (32) module lines. Data distribution circuits S1 through S32 are connected to the left extremity of each module line, and are also connected in series to the main control device 4.

The display incorporates a 128 by 256 dot pattern, and as discussed previously, control data for one dot display is in a 12-bit format. Accordingly, image control data needed for one display frame is calculated as 128×256×12-bits. The image data for one frame is serially output at high speed as arrayed 12-bit data by the main control device 4. A clock signal or display frame synchronization signal is simultaneously output to control the rate of data change.

Because one module line incorporates sixty four (64) lattice modules, and one lattice module includes sixteen (16) lamps which correspond to display dots, image data of 1,064 (16'64) dots is needed for one module line. Each image data distribution circuit (S1 through S32) at each module line receives the necessary 1,064 (16×64) dot data, from the main control device 4, for one module line display within one frame display, and supplies that data to the modules in the line.

The data supplied by the distribution circuits S1 through S32 to each module line is sent to each lattice module sequentially. The circuit built into each module receives and holds in memory its specific 16-dot portion of the 1,064 (64×16) dot image data sent to that module line, and use that data to control illumination of the sixteen (16) lamps in the module. The control system repeatedly sends image data at high speed to the 2,048 (64×32) lattice modules in the panel and thus makes possible static and dynamic image displays, in various colors, on a large-scale 13 by 26-meter transparent display panel having a 32,768 (128×256) dot-matrix pattern.

Module Circuit Structure

Figure 4:
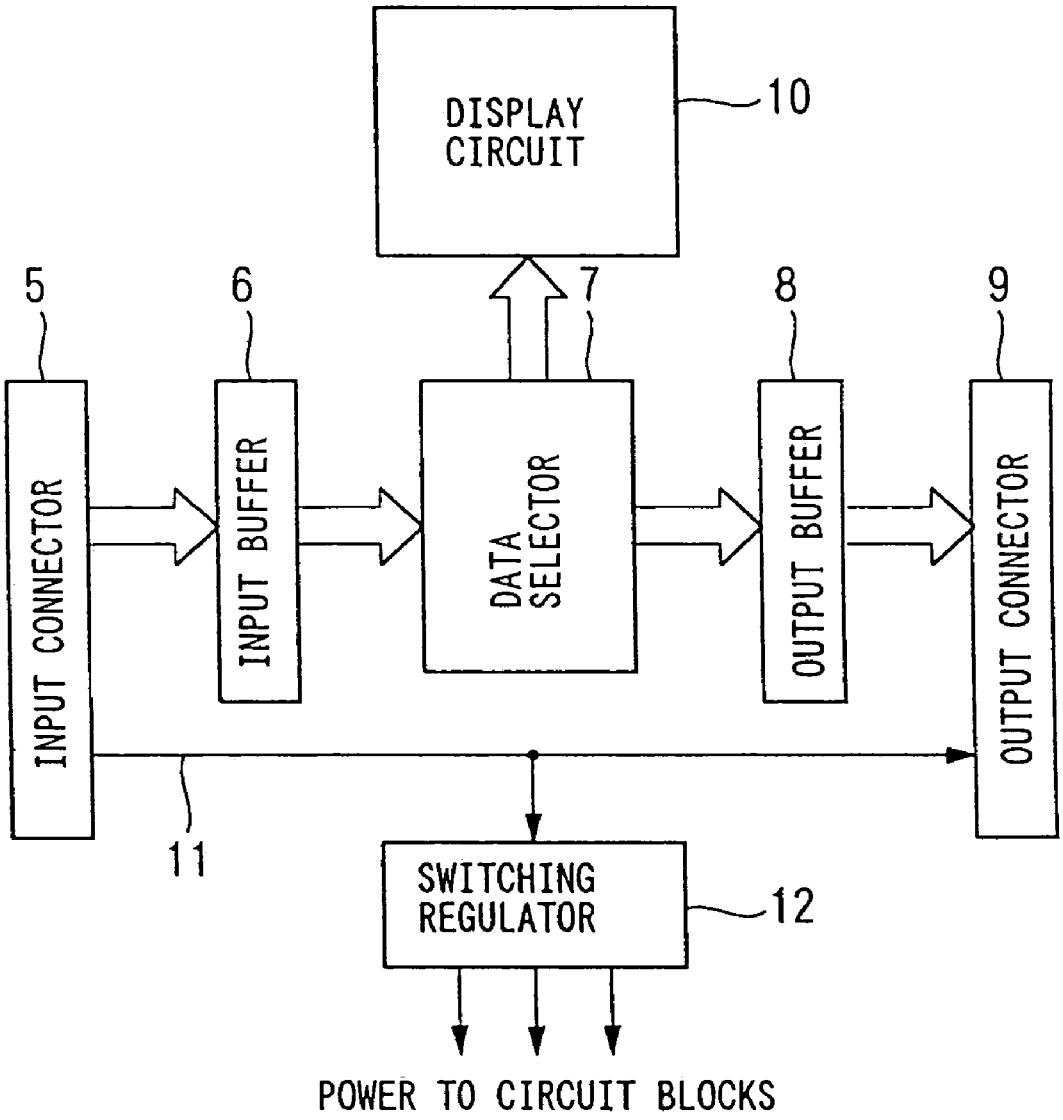
FIG. 4 is a block diagram showing the electrical circuits installed to each lattice module.

FIG. 4 shows the electrical circuit structure contained in one lattice module. As discussed previously, an input connector 5 is installed to the left extremity of each cross member, and an output connector 9 to the right extremity. Input signals coming in from the input connector 5 are processed through an input buffer 6 and supplied to a data selector 7. The data selector 7 extracts the 16-dot data for that specific lattice module and sends it to a display circuit 10 together with the necessary clock or synchronization signal. Furthermore, in order to send various types of signals to the next lattice module in the horizontal array, a wave form or timing generation operation can be executed at an output buffer 8 before those signals are output from the connector 9.

Moreover, a power line 11, which originates at the data distribution circuit on the left extremity of the lattice module line, is installed repeatedly between the input connector 5 and the output connector 9 as a means of supplying power to all sixty four (64) lattice modules in the horizontal line. A switching regulator 12 is installed internally to each lattice module, receives power from an external source, and operates so as to supply a stable electrical current to drive the logic circuits and display lamps within the lattice module.

Figure 5:
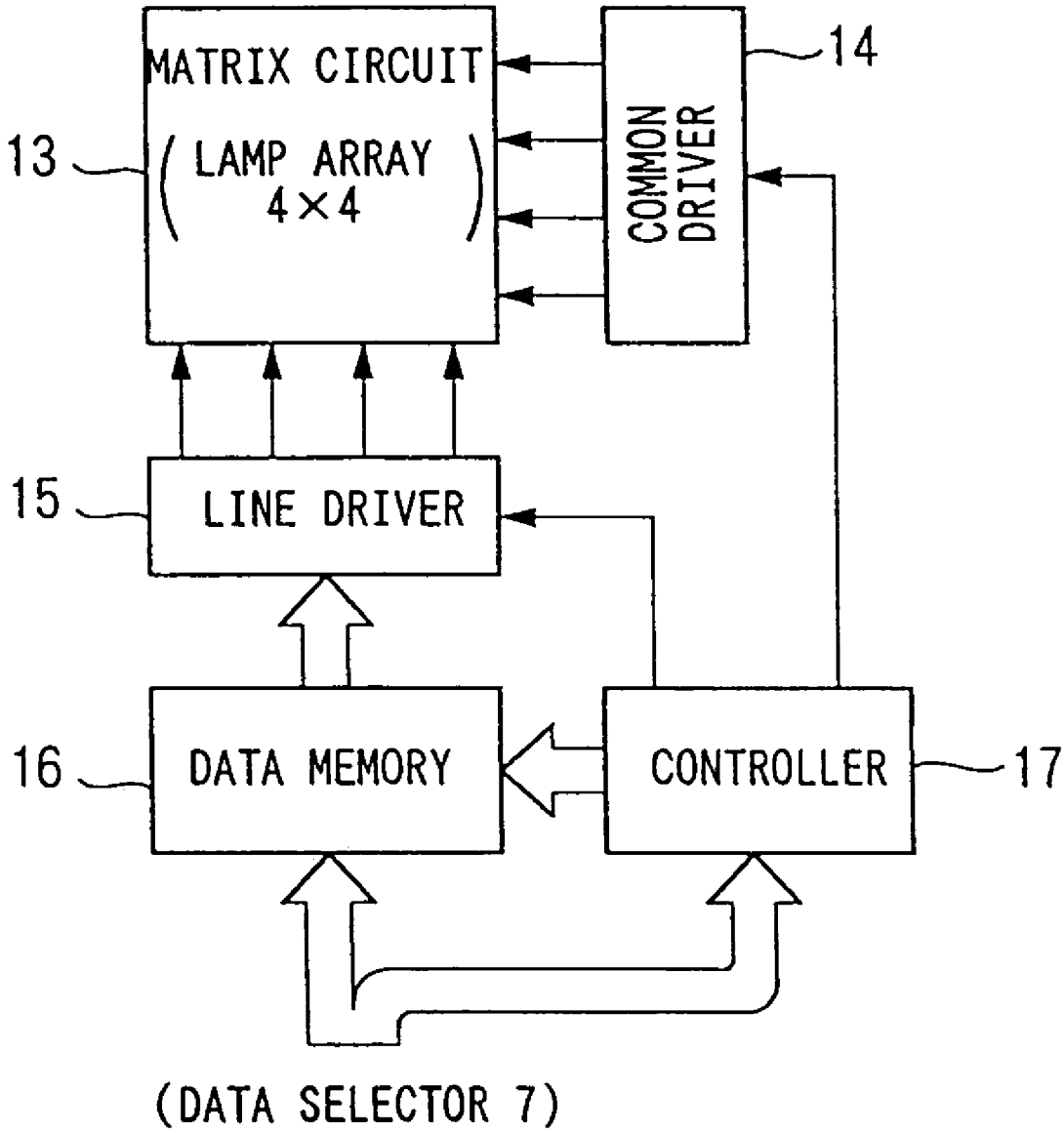
FIG. 5 is a block diagram showing a more detailed description of display circuit 10 of FIG. 4.

FIG. 5 shows the structure of the aforesaid display circuit 10 which is installed within each lattice module. The sixteen (16) display lamps 3 are connected to a 16-dot matrix circuit 13 which controls the illumination of the lamps 3 through a conventional timing operation executed by a common driver 14 and a line driver 15. The extracted 16-dot image data, as well as the applied clock or synchronization signals supplied by the aforesaid data selector 7, are processed through a controller 17 as control data, and temporarily written into a data memory 16. The controller 17 sequentially reads out the image data in the data memory 16 in 4-dot data groups and inputs that data to the line driver 15 while simultaneously scanning the common driver 14.

Display Control System

The 128×256 dot-matrix pattern of the display panel is driven by bit-mapped image data for a 640×1,280 dot-matrix pattern. As was discussed previously, the density of the bit-mapped image data is five times greater than the resolution capability of the display panel.

When this type of image data is used to drive the entire surface of the display panel, there are twenty five (25) dots (5×5) of display data available for one dot on the display panel. As one embodiment of the present invention shows in FIG. 6, nine (9) dots (3×3) can be designated as effective dots within the aforesaid 25-dots of available data, and thus can be driven as multiple dots within a one dot display. Data for the sixteen (16) dots (25-9) surrounding the aforesaid nine (9) effective dots is not utilized. In other words, data for the aforesaid 9-dot group is allocated to each dot on the display, thereby making possible a system which allows all of the image data specified to be used to drive the display.

The bit-mapped image data for a 640×1,280 dot-matrix pattern display is stored in a video RAM device and read accessed at high speed by a display control processor. The display control processor extracts data for one dot of the display from the 9-dot group data by means of an alternating selection operation repeated at high speed according to a specific selection sequence standard, and applies that data as a means of driving one dot on the display. This process is synchronized in order to drive all of the display dots on the 128×256-dot panel at a high speed.

Figure 6:
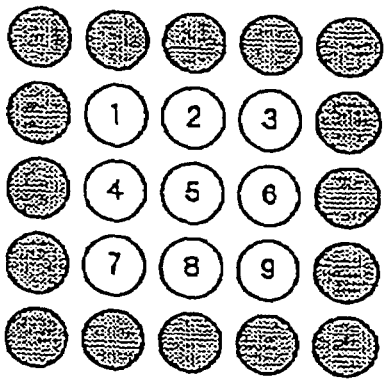
FIG. 6 is an embodiment of the selection sequence standard prescribed by the present invention.

The following discussion will explain a first embodiment of the aforesaid selection sequence standard. As shown in FIG. 6, the data bits within the 9-dot group are labeled 1 through 9. A 1-2-3-4-5-6-7-8-9 sequence can be established, for example, as a first embodiment of the selection sequence standard which is applied to alternately extract the display dot data through a repetitive high-speed selection operation. In cases where the image data in the video RAM is refreshed at intervals of 1/30th of a second, the display control processor will execute nine (9) display scans at 1/270th of a second for each display frame in order to alternately apply each bit of data in the 9-dot group as display drive data. In this example, the data for all nine (9) dots is uniformly and equally utilized.

The following example will explain a second embodiment of the aforesaid selection sequence standard. In this selection sequence, data for dot 5 is extracted at a frequency eight times greater than the other dot data. This selection sequence can be illustrated as 1-5-2-5-3-5-4-5-6-5-7-5-8-5-9-5, a sequence which is continually repeated during the data selection operation.

Figure 7:
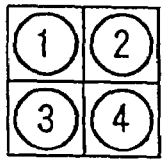
FIG. 7 is a further embodiment of the selection sequence standard prescribed by the present invention.

The data selection sequence standards explained above are by no means limiting embodiments of the present invention. A variety of other data selection sequences can be applied as necessity and application dictate. For example, as FIG. 7 illustrates, the data selection operation can be applied to data for only four display dots in a 1-2-3-4 sequence in which each bit of data is extracted alternately in the repetitive high speed data selection operation. The four display dots are selected from the high-density dot-matrix bit-mapped image data according to a predetermined selection standard to define a multiple dot group. The selection standard may be established dependent on such factors as required quality of actual visibility, clarity, or the like.

Figure 8:
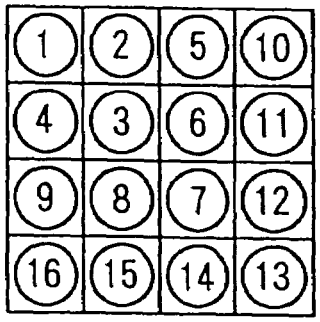
FIG. 8 is a still further embodiment of the selection sequence standard prescribed by the present invention.

FIG. 8 illustrates a further embodiment of the present invention. In this embodiment, a 16-dot display data group is sequentially allocated to one display dot in a sequence in which the data for dot 1 is first extracted and used as display data. This is followed by selection of dots 2, 3, and 4, averaging of the data and then application of that average to drive one display dot. This is in turn followed by selection of dot data 5, 6, 7, 8, and 9, averaging of the data and then application of that average to drive one display dot. The sequence continues with selection of dot data 10, 11, 12, 13, 14, 15, and 16, averaging of the data and then application of that average to drive one display dot. This data selection operation is executed continually and repetitively at high speed.

When images displayed by the display system set forth by the present invention are recorded by a video camera, the respective multiple dots in a small area in one frame of the displayed data energizes a particular point of an imaging element of the video camera subsequently for a very short time at a time. As a result, a more smoothed image effect can be obtained because the image data for the aforesaid small area of multiple dots is averaged on a timed basis. As was discussed previously, the present invention can reduce aliasing distortion, a problem which arises when the image data is thinned out, by creating a low-pass filter effect from the averaging or weighted averaging of an extremely small area of image data.

The human eye works differently than a video camera in that the human eye finds it difficult to keep focus on a single spot, and instead will continually move around a small area of focus. When a display system driven by means of the present invention is viewed by the human eye, the illumination provided by extracting extremely small groups of dots within one frame stimulates different areas of the retina's optic nerve on a sequential basis. When compared to a simple image thinning operation, the image display means provided by the present invention offers the viewer more image data. It is thought that the present invention more closely simulates the characteristics of the human eye and the dynamic nature of vision. While the appearance of the images provided by a display system driven by means of the present invention may vary as a result of perceptual differences between individual viewers, the present invention provides, as previously discussed, an increase in display resolution made possible through a low-pass filter effect and a reduction in aliasing distortion.

As a result of the methods and devices explained in this specification, the present invention provides means of using high-density dot-matrix bit-mapped image data to drive a large-scale low-density dot-matrix display through a new display technology which provides for the best possible image quality and highest resolution within the limits of the display device.

What is claimed is:

1. A method of displaying a digital image on a device comprising one or more pixels, the method comprising:

dividing the digital image into groups of dots;

assigning a group of dots to a corresponding pixel; and for the assigned group, (1) selecting at least a first dot from the assigned group according to a pattern, (2) operating the corresponding pixel based on the selected at least the first dot at a first time instance, (3) selecting at least a second dot different from the first dot from the assigned group according to the pattern, and (4) operating the corresponding pixel based on the selected at least the second dot at the second time instance.

2. The method of claim 1, wherein the pattern specifies one or more of: (i) a probability of selecting each dot in the assigned group, and (ii) an order in which dots in the assigned group are selected.

3. The method of claim 2, wherein the pattern specifies that some dots in the assigned group are selected with higher frequency than other dots in the assigned group.

4. The method of claim 2, wherein the pattern specifies that all dots in the assigned group are selected.

5. The method of claim 1, wherein each group of dots has (i) at most four pixels, (ii) at most nine pixels, (iii) at most sixteen pixels, or (iv) at twenty five pixels.

6. The method of claim 1, wherein the first dot belongs to only one group.

7. The method of claim 1, further comprising, for the assigned group performing mathematical calculations on the selected dots.

8. The method of claim 7, wherein the mathematical calculations comprise averaging.

9. A device comprising one or more pixels for displaying a portion of a digital image, the device comprising:

a data selector operable to select a portion of the digital image;

a display circuit operable to operate the one or more pixels based on the selected portion of the digital image, wherein the display circuit comprises: (i) a memory operable to store the selected portion of the digital image, (ii) a controller operable to select at least one dot from the stored portion of the digital image according to a pattern, wherein the pattern specifies one or more of: (a) the probability of selecting each dot in the assigned group, and (b) the order in which dots in the assigned group are selected for display and (iii) one or more drivers for operating the pixels based on the selected on or more dots.

10. The device of claim 9, wherein the pattern specifies that some dots in the assigned group are selected with higher frequency than other dots in the assigned group.

11. The device of claim 10, wherein the pattern specifies that all dots in the assigned group are selected.

12. The device of claim 11, further comprising, means for performing mathematical calculations on the selected dots.

13. The method of claim 12, wherein the mathematical calculations comprise averaging.

14. A device comprising one or more pixels for displaying a portion of a digital image, the device comprising:

means for selecting a portion of the digital image;

means for storing the selected portion of the digital image;

means for selecting at least one dot from the stored portion of the digital image according to a pattern, wherein the pattern specifies one or more of: (i) the probability of selecting each dot in the selected portion, and (ii) the order in which dots in the selected portion are selected for display; and means for operating a pixel based on the selected at least one dot.

* * * * *

UNITED STATES PATENT AND TRADEMARK OFFICE

CERTIFICATE OF CORRECTION

PATENT NO. : 7,233,303 B2
APPLICATION NO. : 10/690836
DATED : June 19, 2007
INVENTOR(S) : Tokimoto et al.

It is certified that error appears in the above-identified patent and that said Letters Patent is hereby corrected as shown below:

On the Title of the patent please add the following:

Insert Related U.S. Application Data

Item (63) continuation of application Ser. No. 09/862,089 filed on May 21, 2001, now U.S. Pat. No. 6,690,341, which is a continuation of application Ser. No. 09/039,104 filed on March 13, 1998, now abandoned.

Insert

Item (30) Foreign Application Priority Data

Mar. 21, 1997 (JP) ..... 9-68457
Sep. 17, 1997 (JP) ..... 9-252372

Signed and Sealed this

Eighteenth Day of March, 2008

JON W. DUDAS
*Director of the United States Patent and Trademark Office*